US011051096B1

(12) United States Patent
Pournik

(10) Patent No.: US 11,051,096 B1
(45) Date of Patent: Jun. 29, 2021

(54) SWITCHABLE HEADPHONE ASSEMBLY

(71) Applicant: Ali Pournik, Montgomery, TX (US)

(72) Inventor: Ali Pournik, Montgomery, TX (US)

( * ) Notice: Subject to any disclaimer, the term of this patent is extended or adjusted under 35 U.S.C. 154(b) by 0 days.

(21) Appl. No.: 16/787,831

(22) Filed: Feb. 11, 2020

(51) Int. Cl.

| | |
|---|---|
| ***H04R 25/00*** | (2006.01) |
| ***H04R 1/10*** | (2006.01) |
| ***H04R 5/027*** | (2006.01) |
| ***H04R 5/04*** | (2006.01) |

(52) U.S. Cl.
CPC ..... *H04R 1/1041* (2013.01); *H04R 1/1008* (2013.01); *H04R 5/027* (2013.01); *H04R 5/04* (2013.01)

(58) Field of Classification Search
CPC ..... H04R 1/44; H04R 1/025; H04R 3/00
See application file for complete search history.

(56) References Cited

U.S. PATENT DOCUMENTS

| | | | | |
|---|---|---|---|---|
| 3,796,841 | A | 3/1974 | Gorman | |
| 4,404,434 | A | 9/1983 | Pelt | |
| 5,293,647 | A | 3/1994 | Mirmilshteyn | |
| 8,055,006 | B2 | 11/2011 | Santiago | |
| 9,521,479 | B2 | 12/2016 | Lee | |
| D781,265 | S | 3/2017 | Levine | |
| 9,866,944 | B1 | 1/2018 | Wright | |
| 2009/0186322 | A1* | 7/2009 | Johnson | G06F 40/58 434/157 |
| 2012/0027215 | A1* | 2/2012 | Sim | H04R 1/1041 381/55 |
| 2013/0188802 | A1 | 7/2013 | Lin | |
| 2014/0010378 | A1* | 1/2014 | Voix | H04R 3/007 381/57 |
| 2017/0019729 | A1* | 1/2017 | Cochran | H04R 1/1066 |
| 2017/0127168 | A1* | 5/2017 | Briggs | H04R 1/1058 |
| 2017/0193978 | A1 | 7/2017 | Goldman | |
| 2019/0069069 | A1* | 2/2019 | Radin | G06F 3/165 |

* cited by examiner

*Primary Examiner* — Simon King

(57) ABSTRACT

A switchable headphone assembly for facilitating a user to clearly hear ambient sounds while wearing a pair of headphones includes a pair of headphones that is wearable on a user to emit audible sound into each of the user's ears. Each of the headphones is pivotable between an on position or an off position. A respective one the headphones emits audible sound when the respective headphone is in the on position. Moreover, a respective one of the headphones ceases emitting audible sound when the respective headphone is in the off position. In this way the pair of headphones facilitate the user to clearly hear ambient sounds.

13 Claims, 4 Drawing Sheets

SWITCHABLE HEADPHONE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to headphone devices and more particularly pertains to a new headphone device for facilitating a user to clearly hear ambient sounds while the user is wearing headphones.

(2) Description of Related Art Including Information Disclosed Under 37 CFR 1.97 and 1.98

The prior art relates to headphone devices. The prior art discloses a variety of headphones that include pivotal couplings for pivoting ear pieces on the headphones. In one instance of pivotal coupling disclosure the ear pieces are structured to engage arms of eyeglasses. The prior art discloses a variety of headphones that are foldable between a deployed position for use and a stored position for transport. The prior art discloses headphones that have a sound port that can be opened for passing ambient sounds through the headphones. In no instance did the prior art referenced in the patent search disclose a switch that turns the headphones on and off when the ear pieces are pivoted.

BRIEF SUMMARY OF THE INVENTION

An embodiment of the disclosure meets the needs presented above by generally comprising a pair of headphones that is wearable on a user to emit audible sound into each of the user's ears. Each of the headphones is pivotable between an on position or an off position. A respective one the headphones emits audible sound when the respective headphone is in the on position. Moreover, a respective one of the headphones ceases emitting audible sound when the respective headphone is in the off position. In this way the pair of headphones facilitate the user to clearly hear ambient sounds.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
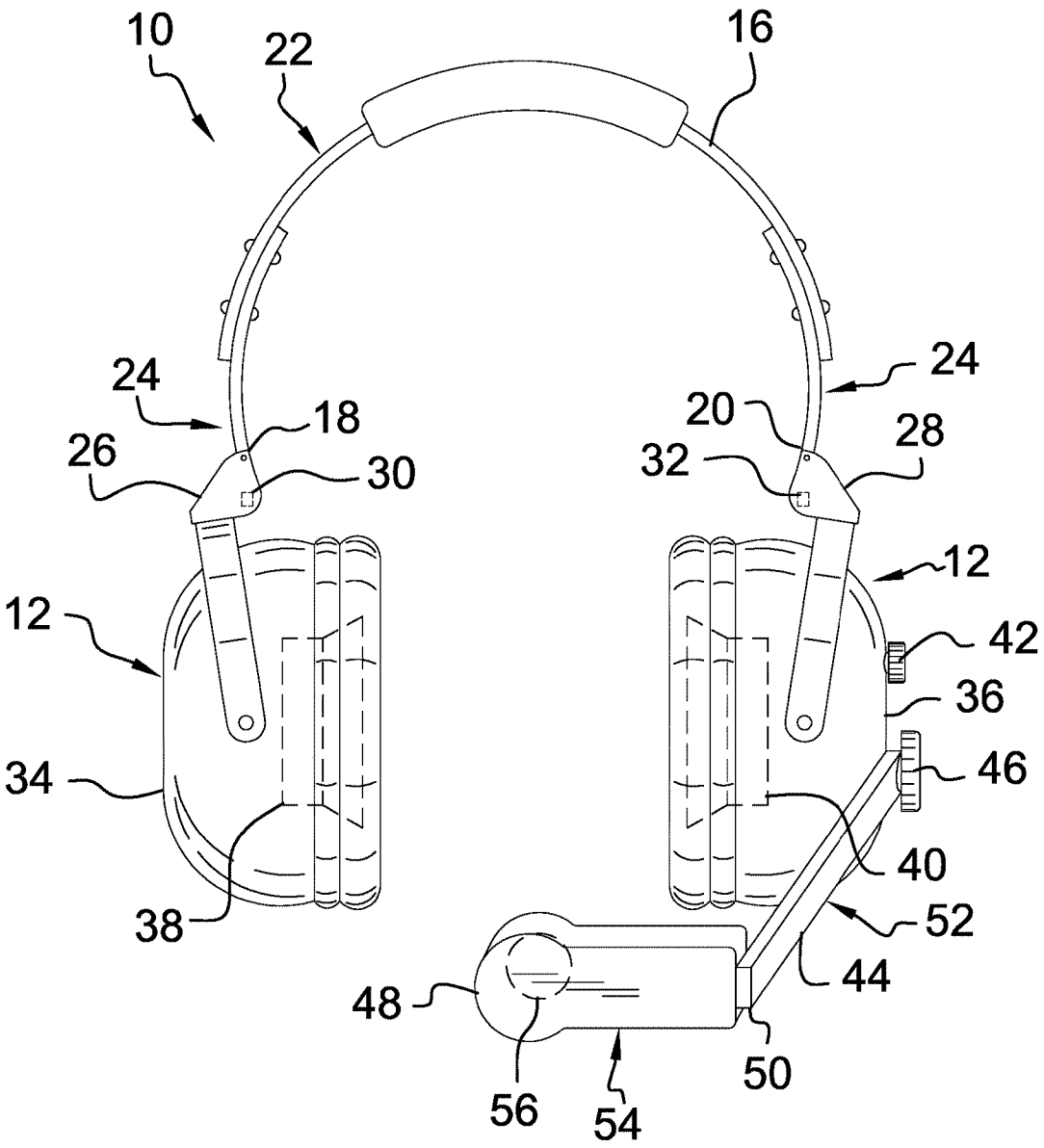
FIG. 1 is a front view of a switchable headphone assembly according to an embodiment of the disclosure.
Figure 2:
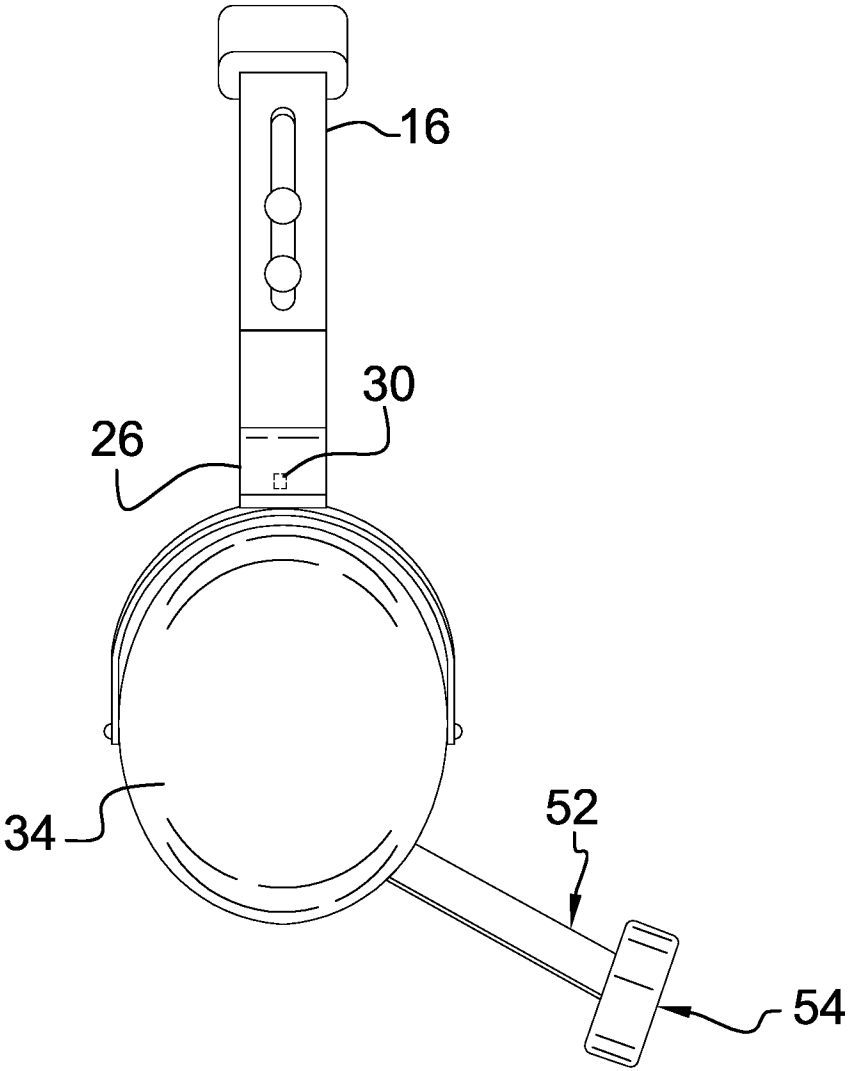
FIG. 2 is a right side view of an embodiment of the disclosure.
Figure 3:
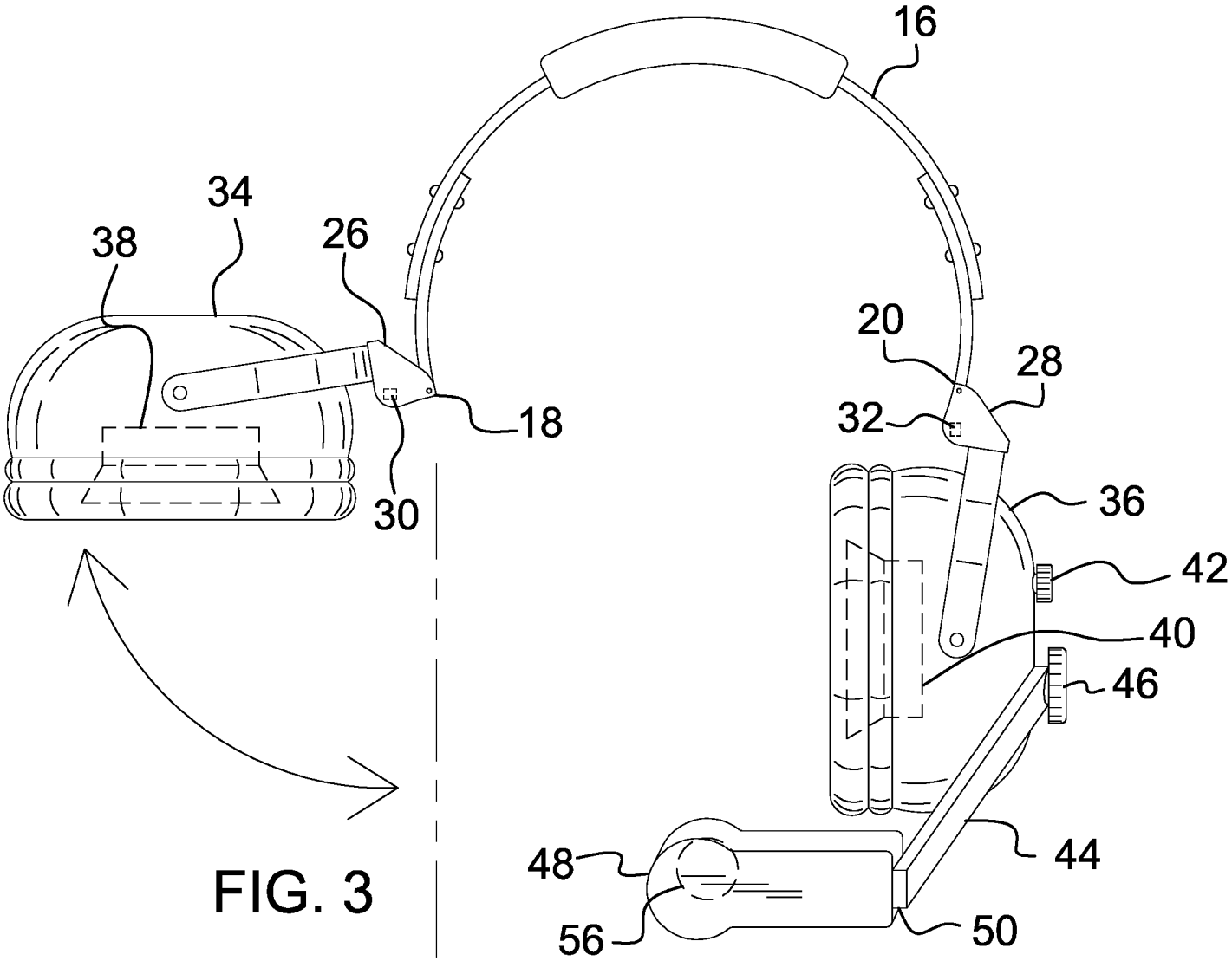
FIG. 3 is a front view of an embodiment of the disclosure showing a first ear muff being pivoted into an off position and showing a second ear muff being in an on position.
Figure 4:
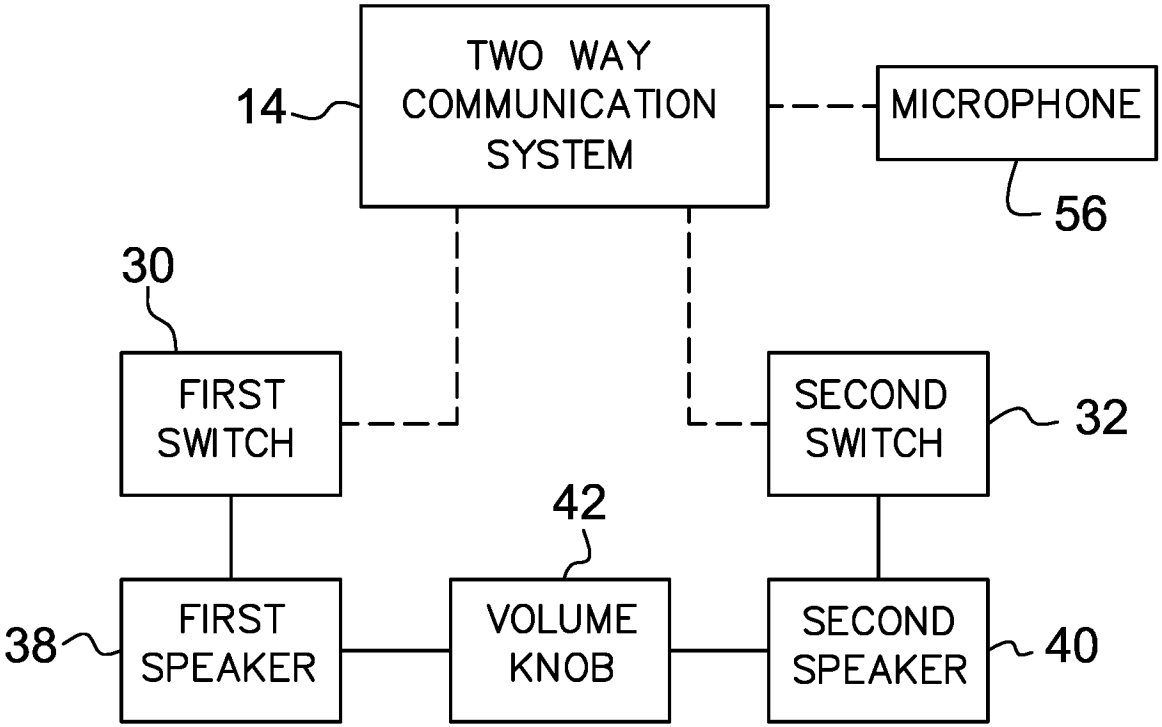
FIG. 4 is a schematic view of an embodiment of the disclosure.

With reference now to the drawings, and in particular to FIGS. 1 through 4 thereof, a new headphone device embodying the principles and concepts of an embodiment of the disclosure and generally designated by the reference numeral 10 will be described.

As best illustrated in FIGS. 1 through 4, the switchable headphone assembly 10 generally comprises a pair of headphones 12 that are wearable on a user when the user is riding in an aircraft. The aircraft may be a helicopter, a fixed wing aircraft or any other type of motorized aircraft that has a two way communication system 14. The headphones 12 are electrically coupled to the two way communication system 14 thereby facilitating the user to communicate with occupants of the aircraft, with other aircraft and with air traffic controllers.

Each of the headphones 12 emits audible sound into each of the user's ears. Each of the headphones 12 is pivotable between an on position and an off position. A respective one the headphones 12 emits audible sound when the respective headphone is in the on position. A respective one of the headphones 12 ceases emitting audible sound when the respective headphone is in the off position. In this way the pair of headphones 12 facilitates the user to clearly hear ambient sounds while wearing the headphones 12.

The pair of headphones 12 comprises a head band 16 that has a first end 18 and a second end 20. The head band 16 is concavely arcuate between the first end 18 and the second end 20. Additionally, the head band 16 comprises a first portion 22 that slidably engages a second portion 24 such that the head band 16 has an adjustable size. The head band 16 is worn over the crown of the user's head when the headphones 12 are worn.

A first pivot 26 is pivotally coupled to the first end 18 of the head band 16. The first pivot 26 is oriented collinear with the head band 16 when the first pivot 26 is positioned in an on position. Additionally, the first pivot 26 is oriented perpendicular to the head band 16 when the first pivot 26 is positioned in an off position. The first pivot 26 extends laterally away from the head band 16 when the first pivot 26 is in the off position. Additionally, the first pivot 26 extends downwardly from the head band 16 when the first pivot 26 is in the on position.

A second pivot 28 is pivotally coupled to the second end 20 of the head band 16. The second pivot 28 is oriented collinear with the head band 16 when the second pivot 28 is positioned in an on position. Additionally, the second pivot 28 is oriented perpendicular to the head band 16 when the second pivot 28 is positioned in an off position. The second pivot 28 extends laterally away from the head band 16 when the second pivot 28 is in the off position. The second pivot 28 extends downwardly from the head band 16 when the second pivot 28 is in the on position.

A first switch 30 is disposed on the first pivot 26 and the first switch 30 is engaged when the first pivot 26 is in the on position. The first switch 30 is disengaged when the first pivot 26 is in the off position. The first switch 30 is in electrical communication with the audio source and the first switch 30 may be any type of electronic switch that can be turned on and off. A second switch 32 is disposed on the second pivot 28 and the second switch 32 is engaged when the second pivot 28 is in the on position. The second switch 32 is disengaged when the second pivot 28 is in the off position. Additionally, the second switch 32 is in electrical communication with the audio source and the second switch 32 may be any type of electronic switch that can be turned on and off.

A first ear muff 34 is movably coupled to the first pivot 26 and the first ear muff 34 covers a respective one of the user's ears when the head band 16 is worn. In this way the first ear muff 34 insulates the respective ear from ambient noise. The first ear muff 34 surrounds the respective user's ear when the first pivot 26 is in the on position. Conversely, the first ear muff 34 exposes the respective user's ear when the first pivot 26 is in the off position.

A second ear muff 36 is movably coupled to the second pivot 28 and the second ear muff 36 covers a respective one of the user's ears when the head band 16 is worn. The second ear muff 36 surrounds the respective user's ear when the second pivot 28 is in the on position. Thus, the second ear muff 36 insulates the respective ear from ambient noise. The second ear muff 36 exposes the respective user's ear when the second pivot 28 is in the off position. Each of the first ear muff 34 and the second ear muff 36 may be comprised of a rigid material that has excellent sound insulation properties.

A first speaker 38 is positioned in the first ear muff 34 to emit audible sound into the respective user's ear. The first speaker 38 is electrically coupled to the first switch 30 and the first speaker 38 is turned on when the first switch 30 is in the on position. Additionally, the first speaker 38 is turned off when the first switch 30 is in the off position. The first speaker 38 may be any type of electronic speaker that would commonly be found in aviation headsets.

A second speaker 40 is positioned in the second ear muff 36 to emit audible sound into the respective user's ear. The second speaker 40 is electrically coupled to the second switch 32 and the second speaker 40 is turned on when the second switch 32 is in the on position. Additionally, the second speaker 40 is turned off when the second switch 32 is in the off position. The second speaker 40 may be any type of electronic speaker that would commonly be found in aviation headsets.

A volume knob 42 is rotatably coupled to the headphones 12 and the volume knob 42 is electrically coupled to each of the first speaker 38 and the second speaker 40. The volume knob 42 adjusts a volume of each of the first speaker 38 and the second speaker 40 between a minimum volume and a maximum volume. A microphone boom 44 is movably coupled to the headphones 12 and the microphone boom 44 is aligned with the user's mouth when the headphones 12 are worn.

The microphone boom 44 has a first end 46 and a second end 48, and the first end 46 of the microphone boom 44 is pivotally coupled to a respective one of the first ear muff 34 or the second ear muff 36. The microphone boom 44 has a bend 50 thereon that is disposed between the first end 18 and the second end 20 to define first portion 52 of the microphone boom 44 forming an angle with a second portion 54 of the microphone boom 44. The second portion 54 of the microphone boom 44 is spaced forwardly from the respective first ear muff 34 or the second ear muff 36 to which the microphone boom 44 is coupled. Moreover, the second portion 54 of the microphone boom 44 is directed toward a respective first ear muff 34 or the second ear muff 36 to which the microphone boom 44 is not coupled. In this way the second portion 24 of the microphone boom 44 can be positioned in front of the user's mouth.

A microphone 56 is coupled to the microphone boom 44 to capture audible sounds from the user. The microphone 56 is in electrical communication with the audio source. Additionally, the microphone 56 is positioned on the second portion 24 of the microphone boom 44 at a point that is located adjacent to the second end 48 of the microphone boom 44. The microphone 56 may be any electronic microphone that would commonly be found in aviation headsets.

In use, the headphones 12 are worn and the headphones 12 are plugged into the audio source via a headphone cable or the like. Thus, the user can communicate with other occupants in the aircraft, with other aircraft and with air traffic controllers. A respective one of the headphones 12 can be pivoted into the off position to turn the respective headphone 12 off and to expose the user's ear. In this way the user can, for example, hear words spoken by an individual in the aircraft or other ambient sounds. The respective headphone 12 is turned back on when the respective headphone 12 is pivoted into the on position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A switchable headphone assembly including pair of earphones that can each be switched on and off, said assembly comprising:

a pair of headphones being wearable on a user wherein each of said headphones is configured to emit audible sound into each of the user's ears, each of said headphones being pivotable between an on position or an off position, a respective one said headphones emitting audible sound when said respective headphone is in said on position, a respective one of said headphones ceasing emitting audible sound when said respective headphone is in said off position wherein said pair of headphones is configured to facilitate the user to clearly hear ambient sounds, said pair of headphones comprising a head band has a first end and a second end, said head band being concavely arcuate between said first end and said second end, said head band comprising a first portion slidably engaging a second portion such that said head band has an adjustable size;

a microphone boom being movably coupled to said headphones wherein said microphone boom is configured to be aligned with the user's mouth when said headphones are worn;

a microphone being coupled to said microphone boom wherein said microphone is configured to capture audible sounds from the user; and a first pivot being pivotally coupled to said first end of said head band, said first pivot being oriented collinear with said head band when said first pivot is positioned in an on position, said first pivot being oriented perpendicular to said head band when said first pivot is positioned in an off position.

2. The assembly according to claim 1, further comprising a second pivot being pivotally coupled to said second end of said head band, said second pivot being oriented collinear with said head band when said second pivot is positioned in an on position, said second pivot being oriented perpendicular to said head band when said second pivot is positioned in an off position.

3. The assembly according to claim 2, further comprising a first switch being disposed on said first pivot, said first switch being engaged when said first pivot is in said on position, said first switch being disengaged when said first pivot is in said off position, said first switch being in electrical communication with an audio source.

4. The assembly according to claim 3, further comprising a second switch being disposed on said second pivot, said second switch being engaged when said second pivot is in said on position, said second switch being disengaged when said second pivot is in said off position, said second switch being in electrical communication with the audio source.

5. The assembly according to claim 4, further comprising a first ear muff being movably coupled to said first pivot wherein said first ear muff is configured to cover a respective one of the user's ears when said head band is worn, said first ear muff surrounding the respective user's ear when said first pivot is in said on position, said first ear muff exposing the respective user's ear when said first pivot is in said off position.

6. The assembly according to claim 5, further comprising a second ear muff being movably coupled to said second pivot wherein said second ear muff is configured to cover a respective one of the user's ears when said head band is worn, said second ear muff surrounding the respective user's ear when said second pivot is in said on position, said second ear muff exposing the respective user's ear when said second pivot is in said off position.

7. The assembly according to claim 6, further comprising a first speaker being positioned in said first ear muff wherein said first speaker is configured to emit audible sound into the respective user's ear, said first speaker being electrically coupled to said first switch, said first speaker being turned on when said first switch is in said on position, said first speaker being turned off when said first switch is in said off position.

8. The assembly according to claim 7, further comprising a second speaker being positioned in said second ear muff wherein said second speaker is configured to emit audible sound into the respective user's ear, said second speaker being electrically coupled to said second switch, said second speaker being turned on when said second switch is in said on position, said second speaker being turned off when said second switch is in said off position.

9. The assembly according to claim 8, further comprising a volume knob being rotatably coupled to said headphones, said volume knob being electrically coupled to each of said first speaker and said second speakers, said volume knob adjusting a volume of each of said first speaker and said second speaker between a minimum volume and a maximum volume.

10. The assembly according to claim 6, wherein said microphone boom has a first end and a second end, said first end being pivotally coupled to a respective one of said first ear muff or said second ear muff, said microphone boom has a bend thereon being disposed between said first end and said second end to define first portion of said microphone boom forming an angle with a second portion of said microphone boom.

11. The assembly according to claim 10, wherein said second portion is spaced forwardly from said respective first ear muff or said second ear muff to which said microphone boom is coupled, said second portion being directed toward a respective first ear muff or said second ear muff to which said microphone boom is not coupled wherein said second portion of said microphone boom is configured to be positionable in front of the user's mouth.

12. The assembly according to claim 11, wherein said microphone is in electrical communication with the audio source, said microphone being positioned on said second portion of said microphone boom at a point being located adjacent to said second end of said microphone boom.

13. A switchable headphone assembly including pair of earphones that can each be switched on and off, said assembly comprising:

a pair of headphones being wearable on a user wherein each of said headphones is configured to emit audible sound into each of the user's ears, each of said headphones being pivotable between an on position or an off position, a respective one said headphones emitting audible sound when said respective headphone is in said on position, a respective one of said headphones ceasing emitting audible sound when said respective headphone is in said off position wherein said pair of headphones is configured to facilitate the user to clearly hear ambient sounds, said pair of headphones comprising:

a head band has a first end and a second end, said head band being concavely arcuate between said first end and said second end, said head band comprising a first portion slidably engaging a second portion such that said head band has an adjustable size;

a first pivot being pivotally coupled to said first end of said head band, said first pivot being oriented collinear with said head band when said first pivot is positioned in an on position, said first pivot being oriented perpendicular to said head band when said first pivot is positioned in an off position;

a second pivot being pivotally coupled to said second end of said head band, said second pivot being oriented collinear with said head band when said second pivot is positioned in an on position, said second pivot being oriented perpendicular to said head band when said second pivot is positioned in an off position;

a first switch being disposed on said first pivot, said first switch being engaged when said first pivot is in said on position, said first switch being disengaged when said first pivot is in said off position, said first switch being in electrical communication with an audio source;

a second switch being disposed on said second pivot, said second switch being engaged when said second pivot is in said on position, said second switch being disengaged when said second pivot is in said off position, said second switch being in electrical communication with the audio source;

a first ear muff being movably coupled to said first pivot wherein said first ear muff is configured to cover a respective one of the user's ears when said head band is worn, said first ear muff surrounding the respective user's ear when said first pivot is in said on position, said first ear muff exposing the respective user's ear when said first pivot is in said off position;

a second ear muff being movably coupled to said second pivot wherein said second ear muff is configured to cover a respective one of the user's ears when said head band is worn, said second ear muff surrounding the respective user's ear when said second pivot is in said on position, said second ear muff exposing the respective user's ear when said second pivot is in said off position;

a first speaker being positioned in said first ear muff wherein said first speaker is configured to emit audible sound into the respective user's ear, said first speaker being electrically coupled to said first switch, said first speaker being turned on when said first switch is in said on position, said first speaker being turned off when said first switch is in said off position;

a second speaker being positioned in said second ear muff wherein said second speaker is configured to emit audible sound into the respective user's ear, said second speaker being electrically coupled to said second switch, said second speaker being turned on when said second switch is in said on position, said second speaker being turned off when said second switch is in said off position; and a volume knob being rotatably coupled to said headphones, said volume knob being electrically coupled to each of said first speaker and said second speakers, said volume knob adjusting a volume of each of said first speaker and said second speaker between a minimum volume and a maximum volume;

a microphone boom being movably coupled to said headphones wherein said microphone boom is configured to be aligned with the user's mouth when said headphones are worn, said microphone boom has a first end and a second end, said first end being pivotally coupled to a respective one of said first ear muff or said second ear muff, said microphone boom has a bend thereon being disposed between said first end and said second end to define first portion of said microphone boom forming an angle with a second portion of said microphone boom, said second portion being spaced forwardly from said respective first ear muff or said second ear muff to which said microphone boom is coupled, said second portion being directed toward a respective first ear muff or said second ear muff to which said microphone boom is not coupled wherein said second portion of said microphone boom is configured to be positionable in front of the user's mouth; and a microphone being coupled to said microphone boom wherein said microphone is configured to capture audible sounds from the user, said microphone being in electrical communication with the audio source, said microphone being positioned on said second portion of said microphone boom at a point being located adjacent to said second end of said microphone boom.

* * * * *